US007455091B2

(12) United States Patent
Thackery et al.

(10) Patent No.: US 7,455,091 B2
(45) Date of Patent: Nov. 25, 2008

(54) CONVERTIBLE HOOD ASSEMBLY FOR A PLANER

(75) Inventors: Clinton Charles Thackery, Anderson, SC (US); Kenneth M. Brazell, Piedmont, SC (US)

(73) Assignee: Eastway Fair Company Limited, Tortola (VG)

( * ) Notice: Subject to any disclaimer, the term of this patent is extended or adjusted under 35 U.S.C. 154(b) by 0 days.

(21) Appl. No.: 11/354,639

(22) Filed: Feb. 15, 2006

(65) Prior Publication Data

US 2007/0186996 A1 Aug. 16, 2007

(51) Int. Cl.
*B27G 19/00* (2006.01)

(52) U.S. Cl. ..... 144/373; 144/114.1; 144/252.2; 409/137; 83/100

(58) Field of Classification Search ..... 144/252.1, 144/252.2, 154.5, 114.1, 117.1, 373; 83/100; 451/449, 453, 456; 409/137; 408/67
See application file for complete search history.

(56) References Cited

U.S. PATENT DOCUMENTS

| | | | | |
|---|---|---|---|---|
| 566,082 | A | 8/1896 | Lawrence et al. | |
| 2,630,846 | A | 3/1953 | Ballantine | |
| 2,780,254 | A | 2/1957 | Carpentiere | |
| 4,485,859 | A | 12/1984 | Krogstad et al. | |
| 5,463,816 | A * | 11/1995 | Bellew et al. | 30/415 |
| 5,815,934 | A * | 10/1998 | Eichberger et al. | 30/475 |
| 6,148,879 | A * | 11/2000 | Liao | 144/117.1 |
| 6,289,956 | B1 * | 9/2001 | Shriver | 144/252.1 |
| 6,382,278 | B1 | 5/2002 | Liao et al. | |
| 6,481,474 | B1 | 11/2002 | Liao et al. | |
| 6,601,621 | B2 | 8/2003 | Wixey et al. | |
| 6,651,710 | B2 | 11/2003 | Chuang | |
| 6,708,744 | B2 | 3/2004 | Wixey et al. | |
| 6,886,615 | B2 | 5/2005 | Wixey et al. | |
| 6,918,419 | B2 | 7/2005 | Wixey et al. | |
| 6,951,231 | B2 | 10/2005 | Garcia et al. | |
| 2005/0224141 | A1 | 10/2005 | Garcia et al. | |
| 2005/0274433 | A1 * | 12/2005 | Thomas | 144/252.1 |

FOREIGN PATENT DOCUMENTS

| | | | |
|---|---|---|---|
| EP | DE3542263 | * | 4/1987 |

* cited by examiner

*Primary Examiner*—Shelley Self
(74) *Attorney, Agent, or Firm*—Michael Best & Friedrich LLP

(57) ABSTRACT

A hood assembly for converting a surface planer between at least two operative modes for expelling chips removed from a workpiece being planed is provided. The hood assembly includes a manifold that is releasably attachable to the carriage assembly. The hood assembly also includes a hood door that is actuatable between at least two operative positions relative to the manifold, thereby providing at least two operative modes for expelling chips from the planer.

22 Claims, 12 Drawing Sheets

CONVERTIBLE HOOD ASSEMBLY FOR A PLANER

FIELD OF THE INVENTION

This invention relates to planers, and more particularly to planers having a convertible hood assembly for expelling chips by way of at least two operative modes.

BACKGROUND

Various power tools are used, particularly in woodworking, in an effort to efficiently and accurately produce a desirable surface finish to a workpiece. A conventional planer is a tool, often used in woodworking, to reduce the thickness of a workpiece or provide a smooth surface to the workpiece after a portion of the thickness has been removed. The planer utilizes at least one rotatably mounted cutting blade. Planers are typically either a hand-operated, power tool or a benchtop machine that may be portable. The hand-operated planer is easily operable by the user, wherein the user moves the planer over a workpiece in order to smooth the surface or make the surface of the workpiece generally flat. Surface planers are generally stationary, but can be transportable between a variety of different locations. Surface planers are adapted to receive the workpiece as the workpiece is fed through the machine. The surface planer is configured to finish the entire surface of the workpiece being fed therethrough.

Conventional surface planers typically utilize at least one rotatably mounted cutting blade attached to a vertically displaceable assembly. The cutting blade can be raised or lowered for a user-defined cutting thickness. The rotating blade generally contacts the upwardly-directed surface of the workpiece, and as the cutting blade rotates, chips or chunks of the workpiece are removed, thereby producing a flat, finished surface. Once the chips of the workpiece are removed, the chips are then expelled through a pathway that is directed away from the user, which is usually out the rear of the machine. In some surface planers, the loose chips are directed downwardly toward the floor or onto the finished surface of the workpiece where they may easily be removed by brushing or the like. In other surface planers, a vacuum is attached to an exhaust such that the loose chips are removed from the workpiece and through suction from the vacuum are disposed in a central disposal location.

Surface planers typically have a cover or shield that is disposed adjacent to the cutting blade or motor, and the cover or shield is adapted to direct the loose chips a particular direction after being removed from the workpiece. The cover or shield is configured to either direct the loose chips away from the cutting blade or to allow for a vacuum hose to be attached thereto so that the loose chips can be easily removed and stored. However, because some surface planers are portable, users may use the surface planers at a variety of locations for different projects. As such, the user may need the loose chips to be removed by a vacuum at one location but the loose chips may be disposed on the floor or ground at another location. In other situations in which the surface planer is not portable, a user may still want to choose between at least two modes of disposing of the loose chips removed from the workpiece. The prior art cover or shields usable on surface planers are designed for one or the other of these modes of disposal, but not both. As such, the user may need to purchase the alternative cover or shield in order to utilize the surface planer in another mode of disposal of chips.

Because the cover or shield that directs the loose chips away from the cutting blade is generally limited to a single purpose or mode, when the user desires to modify the surface planer in order to change the mode of disposal of the loose chips, the cover or shield needs to be removed and replaced with an alternative cover or shield. Such replacement can be tedious or cumbersome. Additionally, it is also necessary that the user store the alternative cover or shield, and storage of such a piece may lead to lost parts as well as wasted space within what may already be a limited working area. Further, because an alternative cover or shield for performing an alternative mode of disposal of loose chips may not be included with the purchased surface planer, the additional cover or shield may need to be purchased, thereby increasing the cost of using the machine.

There remains, therefore, a need for a cover or shield that is attachable to the surface planer that overcomes the limitations, shortcomings and disadvantages of other covers or shields.

BRIEF SUMMARY

The present invention relates to a method and assembly for converting a surface planer between at least two operative modes for expelling chips removed from a workpiece being planed by the surface planer. In one aspect of the present invention, a hood assembly for a surface planer is provided. The hood assembly includes a manifold that is releasably attachable to a carriage assembly of the surface planer. The manifold has an outlet aperture formed therewith, and the chips from a workpiece can be expelled through the outlet aperture. The hood assembly further includes a hood door that is rotatably attached to the manifold. The hood door is actuatable between at least a first operative position and a second operative position for providing at least two modes of expelling the chips from the surface planer.

In another aspect of the present invention, a method for converting a surface planer between a first operative mode and a second operative mode is provided. The method includes attaching a hood assembly to the surface planer, wherein the hood assembly includes a manifold and a hood door. The manifold includes an outlet aperture through which chips from a workpiece can be expelled. The hood door is actuatable between at least a first operative position and a second operative position relative to the manifold. The method further includes actuating the hood door between the first operative position which provides the first operative mode and the second operative position which provides the second operative mode.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

Figure 1:
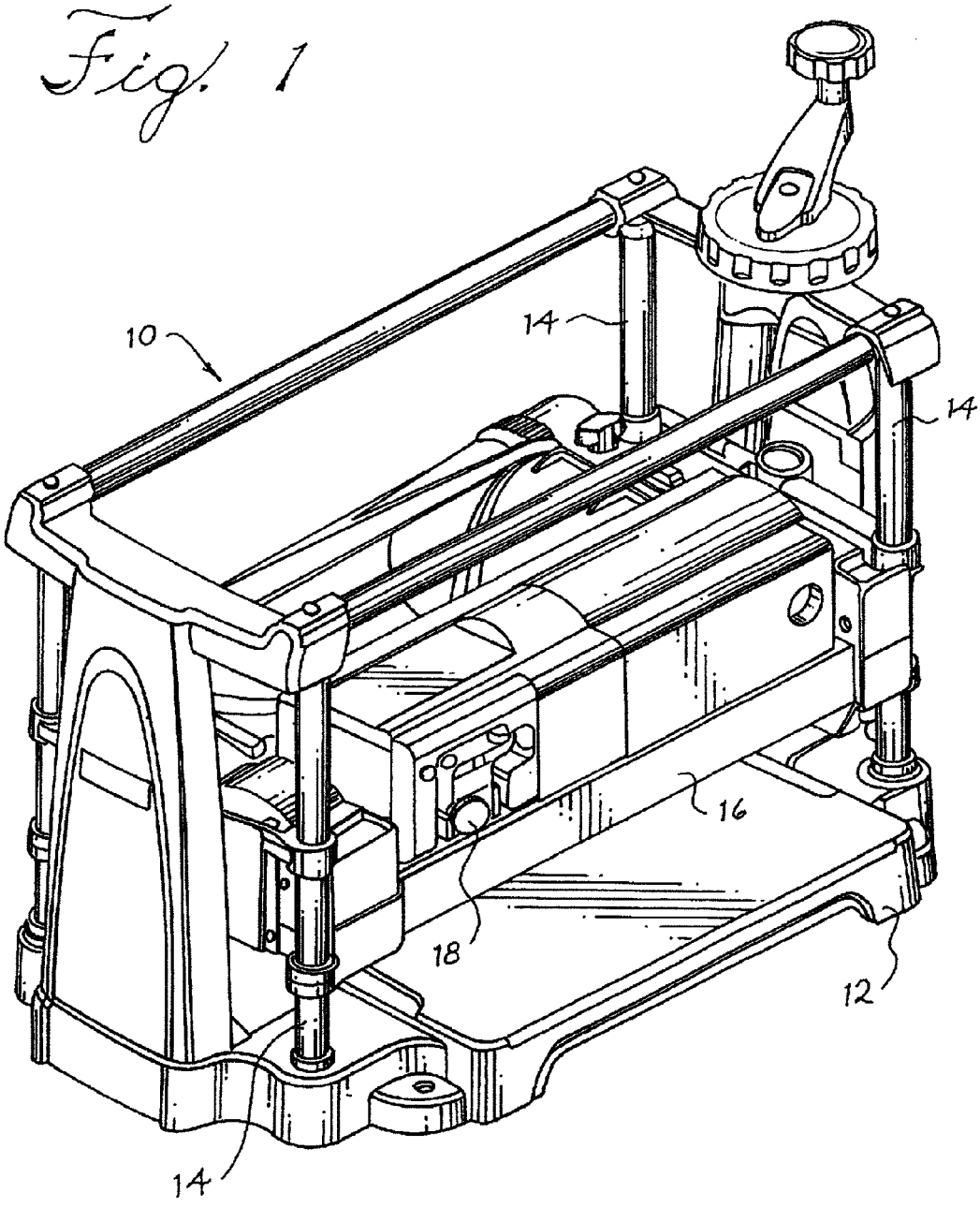
FIG. 1 is a front perspective view of a conventional surface planer to which one embodiment of a hood assembly is attached.

Referring to FIG. 1, an exemplary embodiment of a surface planer 10 is shown. The planer 10 includes a base 12 having a plurality vertically-extending columns 14 extending from the base 12 and a carriage assembly 16 slidingly engaged with the columns 14. The carriage assembly 16 includes a motor (not shown) that drives at least one rotatable cutting blade (not shown). The carriage assembly 16 is translatable along columns 14 in a substantially vertical manner relative to the base 12. The carriage assembly 16 is translatable relative to the base 12 to allow the user to define the resulting thickness of a workpiece being finished by the planer 10. As the carriage assembly 16 is lowered toward the base 12, the thickness of the finished workpiece will be thinner.

In operation, a switch 18 is actuated between a first position (on) and a second position (off), thereby turning the motor on and off. When the motor is on, or in an operating mode, a workpiece is disposed in the space between the base 12 and the carriage assembly 16, wherein the workpiece is in an abutting relationship with the base 12. The workpiece is disposed adjacent to the base 12 such that the surface of the workpiece to be planed, or finished, is directed upward toward the carriage assembly 16. The motor drives a blade assembly located within the carriage assembly 16, thereby causing a plurality of cutting blades to rotate. As the rotating blades contact the upwardly-directed surface of the workpiece, the blades cut the workpiece, thereby forming shavings of chips or pieces of the workpiece. The rotation of the blades directs the chips toward the rear of the planer 10 to be expelled through an exhaust port (not shown) in the carriage assembly 16. The cooling air from the motor assists in transporting the loose chips removed from the workpiece through the exhaust port in the carriage assembly to be expelled therefrom.

Figure 2:
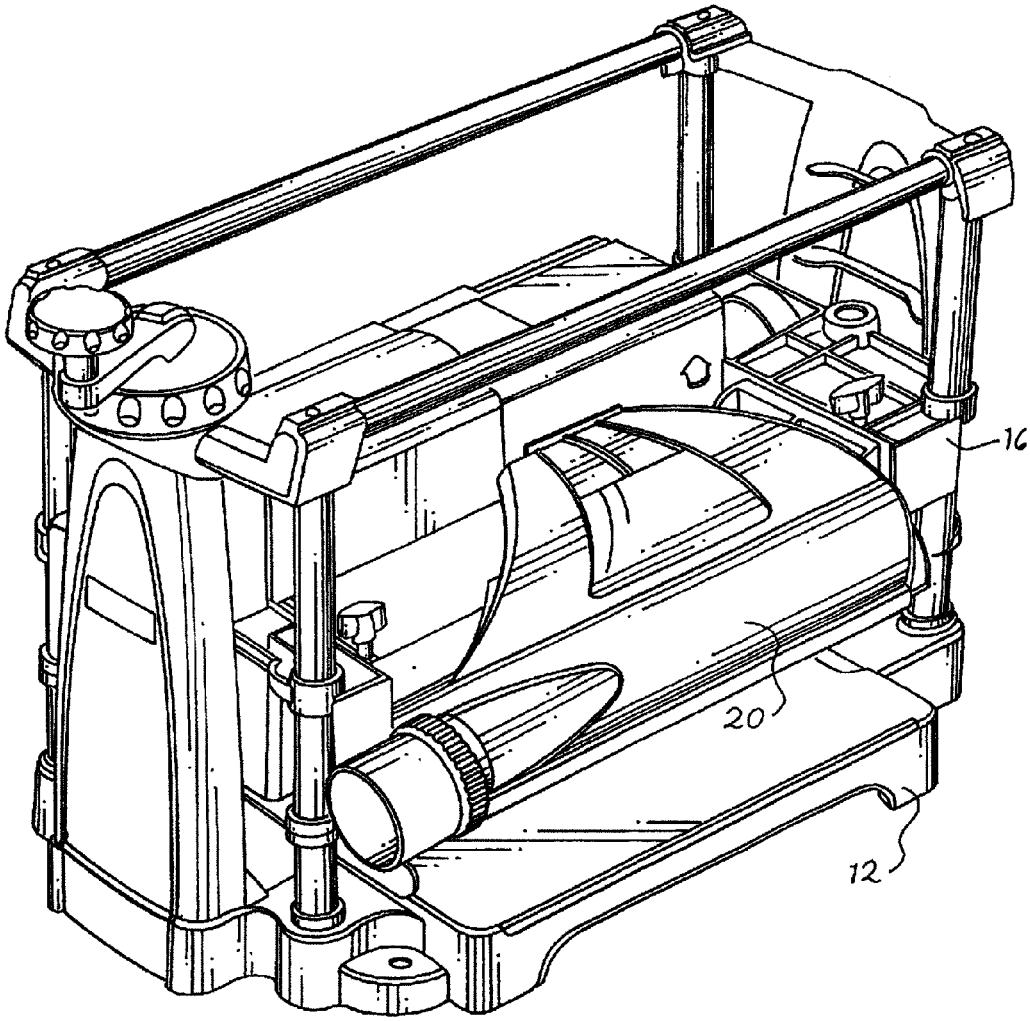
FIG. 2 is a rear perspective view of the surface planer and hood assembly of FIG. 1.

The rearwardly-directed chips are transferred from the carriage assembly to a convertible hood assembly 20, as illustrated in FIG. 2. The hood assembly 20 is attached to the carriage assembly 16 at an operable position adjacent to the exhaust port of the carriage assembly 16. When the hood assembly 20 is in an operable position, the hood assembly 20 is secured to the carriage assembly 16 of the planer 10 and is capable of selectively directing loose chips that are removed from a workpiece by the blades in the carriage assembly 16. The hood assembly 20 is attached to the carriage assembly 16 such that the hood assembly 20 remains in a substantially fixed relationship relative to the exhaust port of the carriage assembly 16. The hood assembly 20 translates with the carriage assembly 16 as the user displaces the carriage assembly 16 in the vertical direction relative to the base 12.

Figure 3:
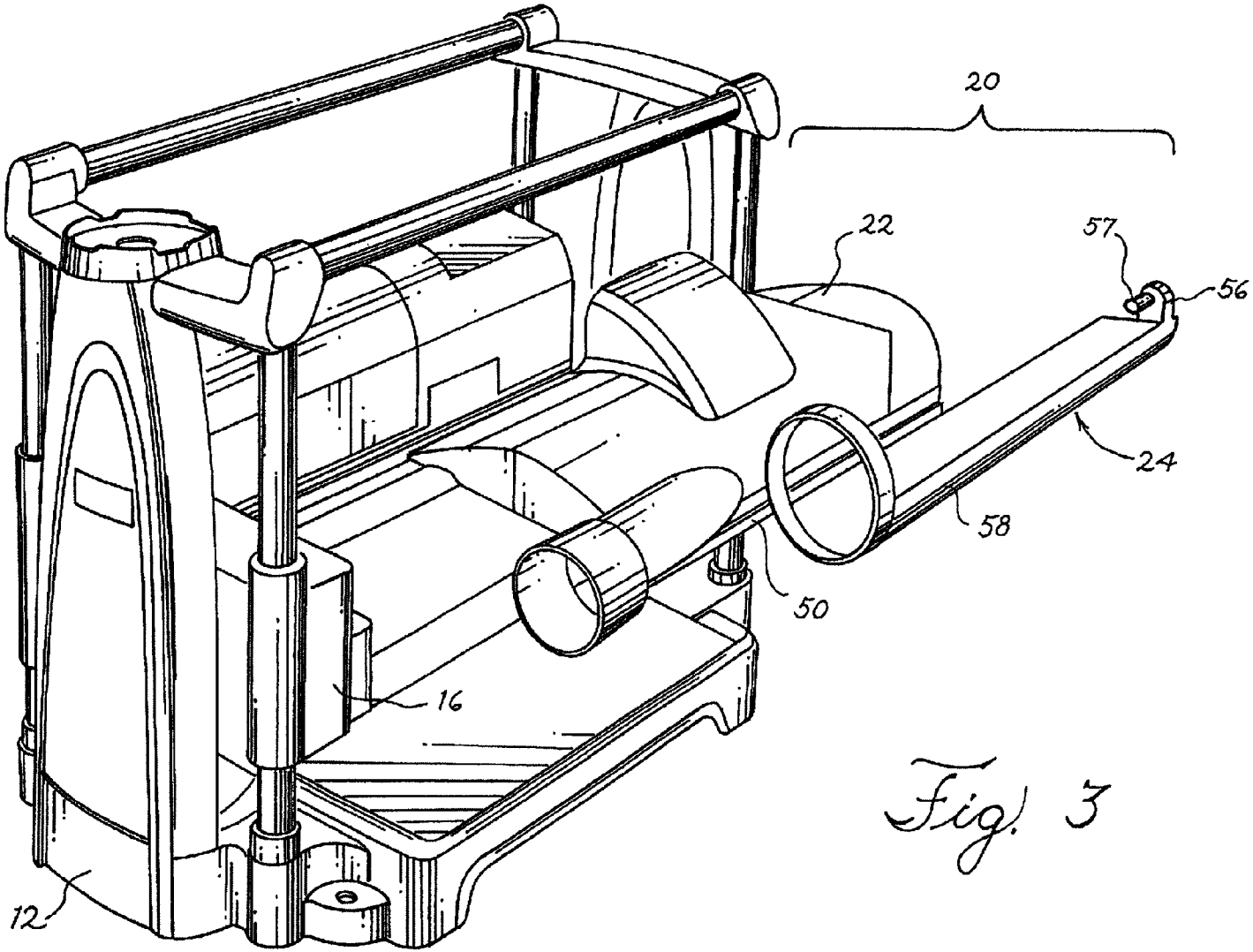
FIG. 3 is an exploded view of one embodiment of a hood assembly and a surface planer.

One embodiment of a hood assembly 20, as shown in FIGS. 3-8, can be operatively connected to the carriage assembly 16 of a planer 10. As illustrated in FIG. 3, the hood assembly 20 can be formed of two members, a manifold 22 and a hood door 24. These pieces are formed separately such that the hood door 24 can be actuated relative to the manifold 22 in order to switch, or convert, the hood assembly 20 between a first operative mode and a second operative mode. When the hood assembly 20 is in the first operative mode, or exhausting mode, the loose chips are expelled from the planer to the surrounding work area. When the hood assembly 20 is in the second operative mode, or vacuum mode, a vacuum is operatively attached to the hood assembly 20 by way of a vacuum hose such that the loose chips are removed from the planer 10 and directed to a storage location for storage or disposal.

Figure 4:
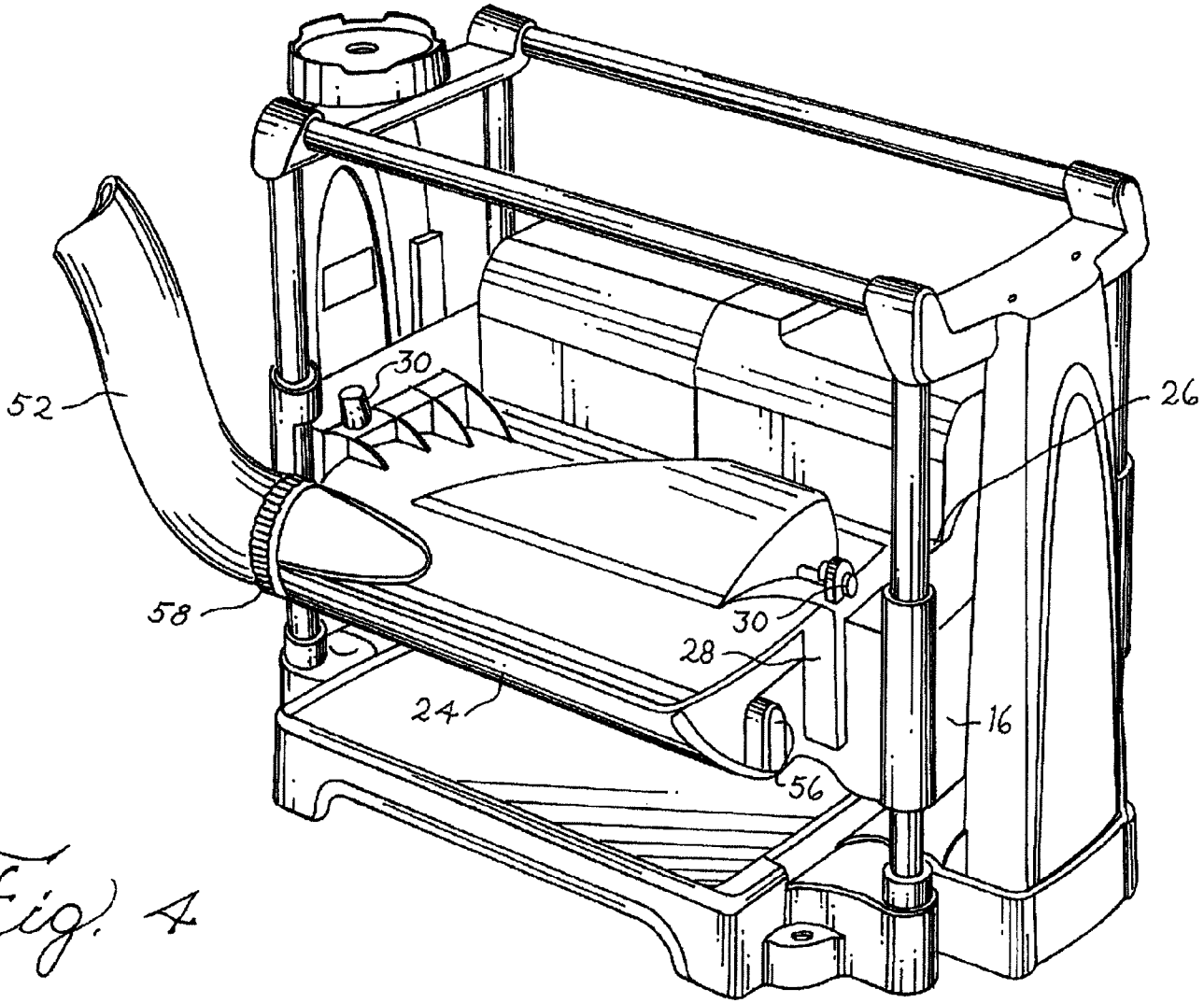
FIG. 4 is a hood assembly shown in a vacuum mode in which a vacuum tube is attached to the hood assembly.
Figure 5:
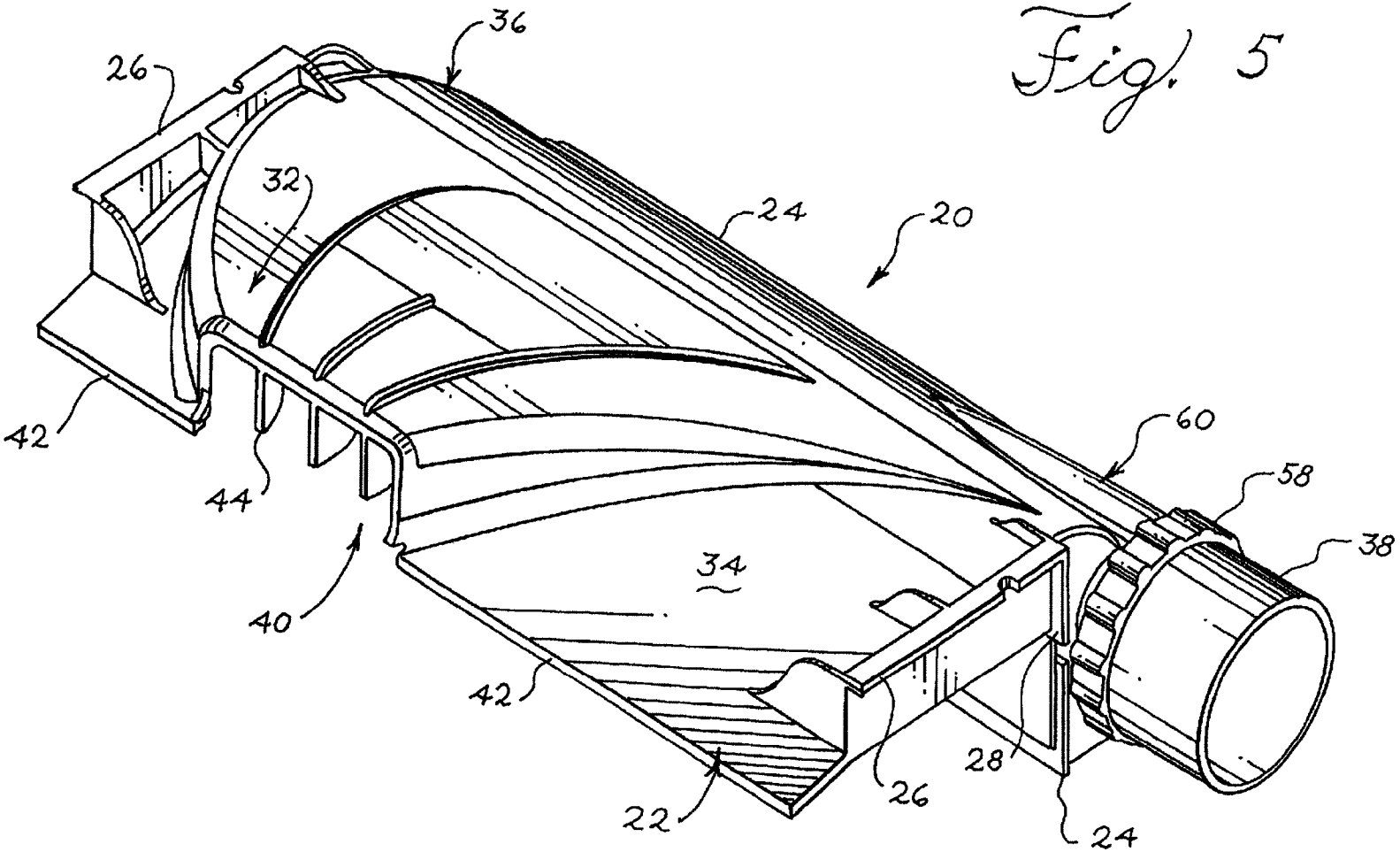
FIG. 5 is a perspective view of a first embodiment of a hood assembly.

In one embodiment, each end of the manifold 22 of the hood assembly 20 includes a lateral ledge 26 and a vertical ledge 28 extending therefrom, as shown in FIGS. 4-5. The lateral ledge 26 extends from the manifold 22 in a substantially horizontal manner, and the vertical ledge 28 extends from the manifold 22 in a substantially vertical manner. Each lateral ledge 26 and vertical ledge 28 is adapted to be disposed adjacent to the carriage assembly 16 in an abutting manner when the manifold is in an operable position. The manifold 22 is releasably attachable to the carriage assembly 16, whereby a thumb screw 30 can be used to secure the manifold 22 to the carriage assembly 16. A thumb screw 30 can provide a secure connection between a lateral ledge 26 and the carriage assembly 16, a vertical ledge 28 and the carriage assembly, or a combination thereof. Any other securing means for removably attaching the manifold 22 to the carriage assembly can be used including, but not limited to, a wing nut or a bolt. When the manifold 22 is secured to the carriage assembly 16, the manifold 22 can receive the loose chips removed from the workpiece by the blade assembly of the carriage assembly 16 and either direct the chips into the surrounding working area or allow them to be transported to a central storage location.

The manifold 22 includes a contoured member 32 extending from the top surface 34, a collection portion 36, and an exhaust port 38, as shown in FIG. 5. The inlet 40 is adjacent to, or can be a part of, the front edge 42 of the manifold 22, and extends upwardly relative to the top surface 34. When the manifold 22 is operatively attached to the carriage assembly 16, the inlet 40 of the contoured member 32 is disposed adjacent to the exhaust port of the carriage assembly 16 through which the loose chips exit the carriage assembly 16. In one embodiment, the shape of the inlet 40 can be substantially similar to the exhaust port of the carriage assembly 16 such that when the hood assembly 20 is in an operative position, the inlet 40 of the manifold 22 is disposed immediately adjacent to the exhaust port of the carriage assembly 16 in an abutting manner and the inlet 40 completely surrounds the exhaust port to direct the loose chips through the contoured member 32 of the manifold 22 toward the collection portion 36. In an alternative embodiment, the inlet 40 can be formed as an inverted U-shaped member, and the shape of the inlet 40 is substantially similar to the corresponding shape of the exhaust port of the carriage assembly 16. When the hood assembly 20 is in an operable position, the inlet 40 and front edge 42 of the manifold 22 is immediately adjacent to the exhaust port of the carriage assembly 16 to direct the loose chips through the contoured member 32 of the manifold 22 toward the collection portion 36.

Figure 6:
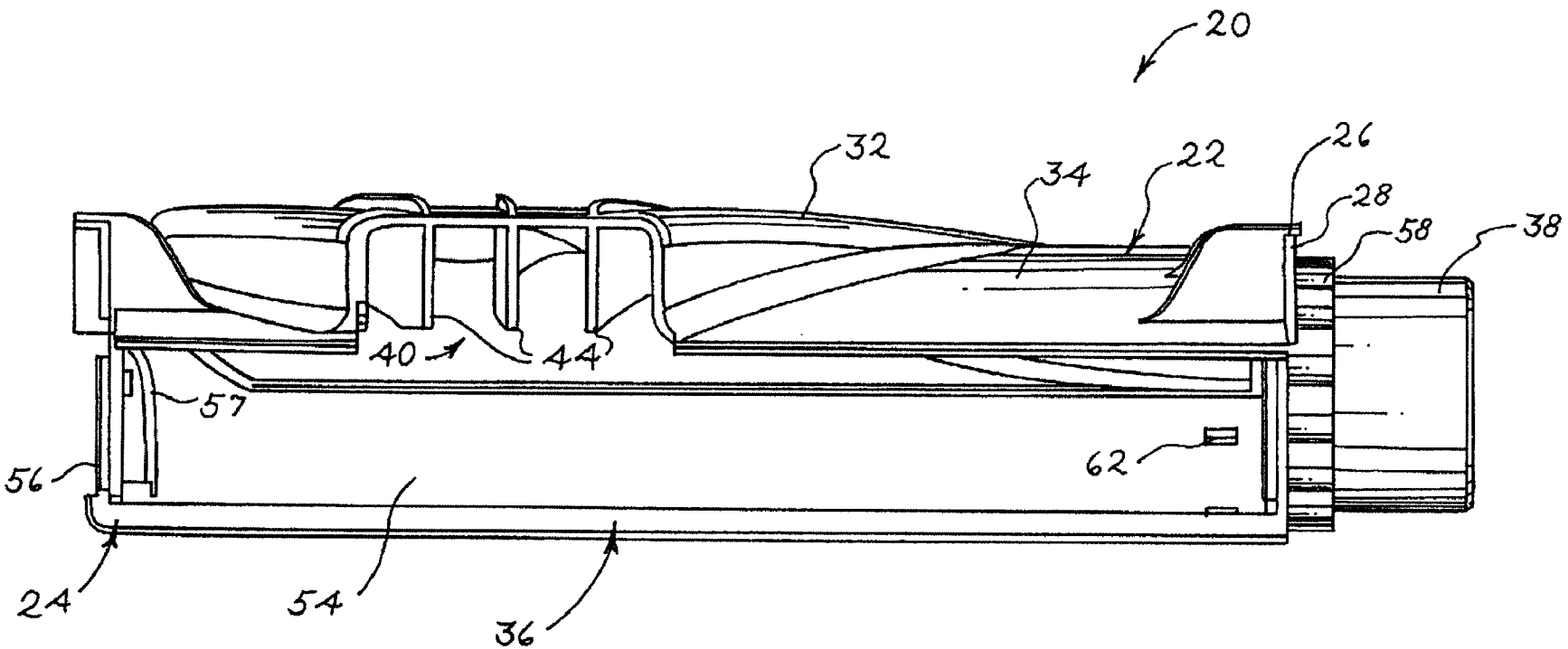
FIG. 6 is a front view of the hood assembly of FIG. 5.

The contoured member 32 extends from the front edge 42 of the manifold 22 toward the collection portion 36 that is disposed at the opposing side of the manifold 22, as shown in FIGS. 5-6. The height above the top surface 34 from which the contoured member 32 extends gradually decreases as the contoured member 32 extends away from the front edge 42 until the contoured member 32 joins the top surface 34 and does not extend upwardly therefrom. The width of the contoured member 32 can also gradually increase as the contoured member 32 extends away from the front edge 42.

Figure 7:
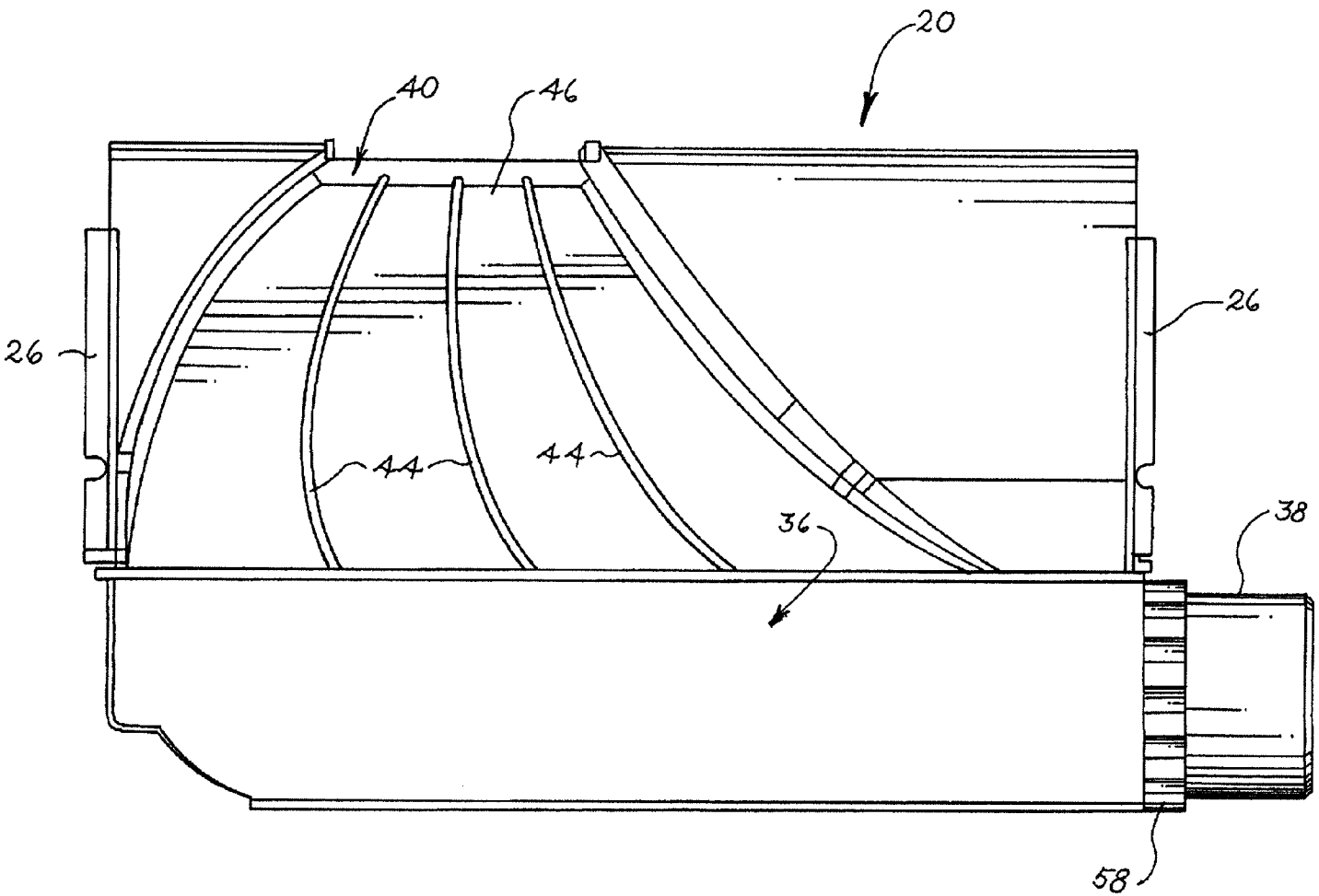
FIG. 7 is a bottom view of the hood assembly of FIG. 5.

A plurality of ribs 44 extend in a substantially vertical manner from the downwardly-directed surface of the contoured member 32, as shown in FIGS. 6-7. The ribs 44 can have a curvature such that when the loose chips enter the manifold 22 through the inlet 40, the ribs 44 are configured to direct the exhaust air from the motor toward the exhaust port 38 adjacent to the collection portion 36. The ribs 44 extend downwardly from the bottom surface 46 of the contoured member 32, and the height of the ribs 44 decreases as the ribs 44 extend away from the inlet 40 toward the collection portion 36 in a manner similar to the decrease in height of the contoured member 32 relative to the top surface 34 of the manifold 22. In an alternative embodiment, the ribs 44 extend from the inlet 40 in substantially planar manner.

The ribs 44 are configured to direct loose chips from the workpiece into the collection portion 36 of the manifold 22, as shown in FIG. 6. The collection portion 36 of the manifold 22 is a generally cylindrical area when the hood door 24 is rotated to be in abutting engagement with the carriage assembly 16, and the collection portion has a longitudinal axis that is substantially transverse to the orientation of the workpiece being fed through the planer 10. The generally cylindrical shape of the collection portion 36 allows the loose chips to circulate therein until the loose chips are expelled into the surrounding working area or removed by a vacuum attached to the hood assembly 20. It should be understood by one skilled in the art that the collection portion 36 can be any shape sufficient to maintain a relatively smooth flow of loose chips and prevent loose chips from clogging the exhaustion of the chips. The cylindrical portion 36 further includes an outlet aperture 50, as shown in FIG. 3, which is configured to direct the loose chips into the surrounding working area when the hood assembly 20 is in the exhausting mode.

An exhaust port 38 extends laterally outward from the collection portion 36, as shown in FIG. 5. The exhaust port 38 is a tubular member that is adapted to receive, and be operatively connected to, a vacuum hose 52 (FIG. 4) that is attached to a vacuum (not shown). It should be understood by one skilled in the art that the exhaust port 38 can extend from the hood assembly 20 at any location sufficient to remove the loose chips being removed from the workpiece being planed.

The hood assembly 20 further includes a hood door 24 that is actuatable relative to the manifold 22, as shown in FIGS. 3-5 and 9. The hood door 24 is preferably rotatable or pivotable relative to the manifold 22, but any other manner of actuation of the hood door 24 relative to the manifold 22 can be performed. The hood door 24 includes a contact surface 54, a hinge member 56, and a dial 58. The hinge member 56 and dial 58 are disposed at opposing ends of the collection portion 36, wherein the hinge member 56 and the dial 58 provide a rotational mechanism that allows the hood door 24 to pivot or rotate relative to the manifold 22 between at least a first operative position and a second operative position. Selective actuation of the hood door 24 relative to the manifold 22 allows the hood assembly 20 to be switched between the first operative, exhausting mode and the second operative, vacuum mode. The manner of expulsion of the loose chips removed from the workpiece is selectively chosen by the user as the user rotates the hood door 24 between a first operative position and a second operative position. At one end of the hood door 24, a hinge member 56 includes a pin 57 (FIGS. 3 and 6) that is adapted to be received in a corresponding aperture (not shown) in the manifold 22. The dial 58 is a substantially circular member having a radius that is slightly larger than the outer radius of the exhaust port 38 of the manifold 22 such that the dial 58 is disposed about the outer surface of the exhaust port 38 in an abutting, sliding relationship. The pin 57 of the hinge member 56 is axially aligned with the center of the dial 58, thereby providing a rotational or pivotal axis about which the hood door 24 is rotatable or pivotable relative to the manifold 22. The contact surface 54 extends between the hinge member 56 and the dial 58.

As shown in FIG. 5, the dial 58 includes a plurality of raised and lowered surfaces that allow the user to easily grasp the hood door 24. The hood door 24 is rotatable or pivotable between at least a first operative position (FIG. 9) and a second operative position (FIG. 4). When the hood door 24 is in the first operative position, the hood assembly 20 is in the first operative, exhausting mode; and when the hood door 24 is in the second operative position, the hood door 24 is in the second operative position, the hood assembly 20 is in the second operative, vacuum mode. As illustrated in FIG. 5, the collection portion 36 of the manifold 22 has at least one protrusion 60 extending therefrom at a position adjacent to the dial 58, but it should be understood by one skilled in the art that the protrusion 60 can be disposed at any location on the manifold 22 between the dial 58 and the hinge member 56. The protrusion 60 on the manifold 22 is adapted to be received in a corresponding detent 62 (FIG. 6) that is formed on the hood door 24 to secure the hood door 24 in the first operative position relative to manifold 22.

Figure 9:
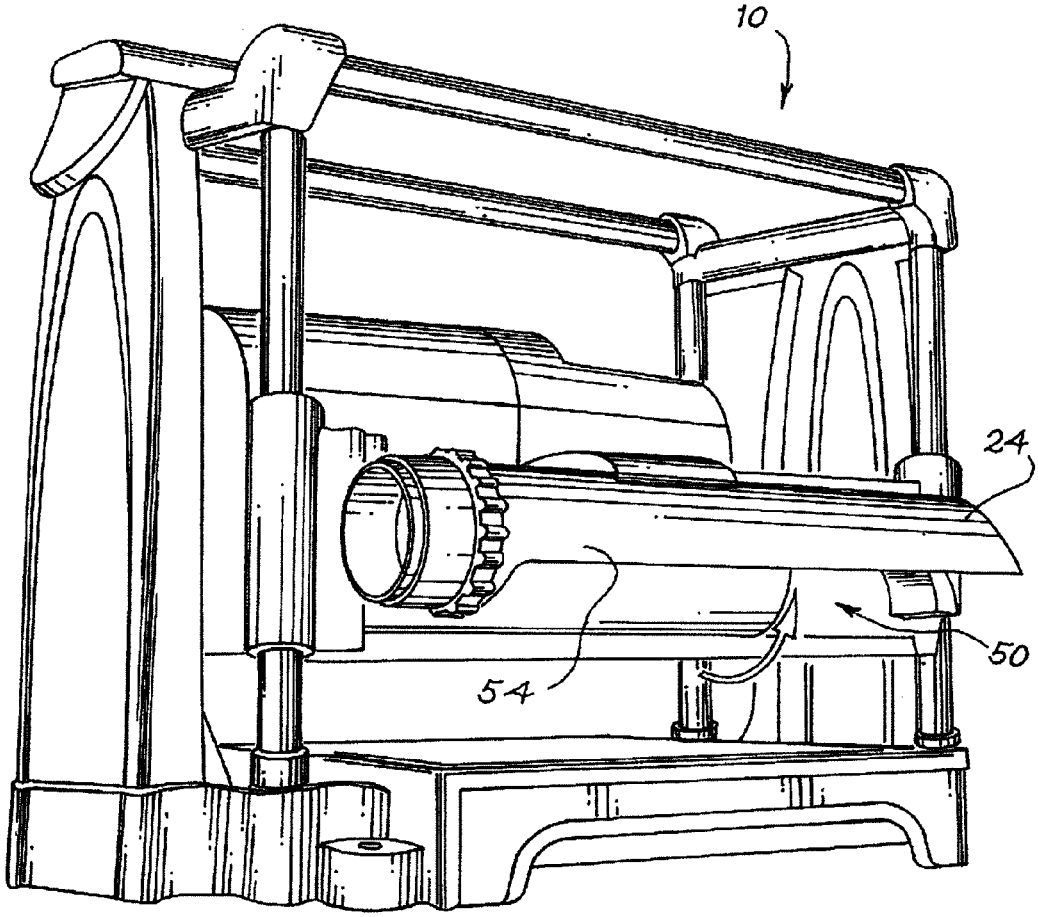
FIG. 9 is an illustration of the rotation of a hood door relative to a manifold.

When the hood door 24 is selectively rotated or pivoted to the first operative position, as shown in FIG. 9, the protrusion 60 is received in the corresponding detent 62, thereby securing the hood door 24 in the first operative position relative to the manifold 22. When in the first operative position, the hood door 24 exposes the outlet aperture 50 of the manifold 22 such that the loose chips are directed toward, and expelled through, the outlet aperture 50. The outlet aperture 50 is an opening exposed between the hood door 24 and the carriage assembly 16 when the hood door 24 is in a position spaced-apart from the carriage assembly 16, and the loose chips are directed through the outlet aperture 50 into the working area surrounding the planer 10. The protrusion 60 on the manifold 22 may act as a limit for the rotation of the hood door 24 relative to the manifold 22, but is should be understood by one skilled in the art that any other stop mechanism can be used to limit the rotation of the hood door 24 relative to the manifold 22. It should also be understood by one skilled in the art that the protrusion 60 and corresponding detent 62 form an engagement mechanism such that the hood door 24 is engaged with the manifold 22 when the protrusion 60 is received in the corresponding detent 62, but any other engagement mechanism sufficient to provide a releasable engagement between the hood door 24 and the manifold 22 can be used.

Figure 8:
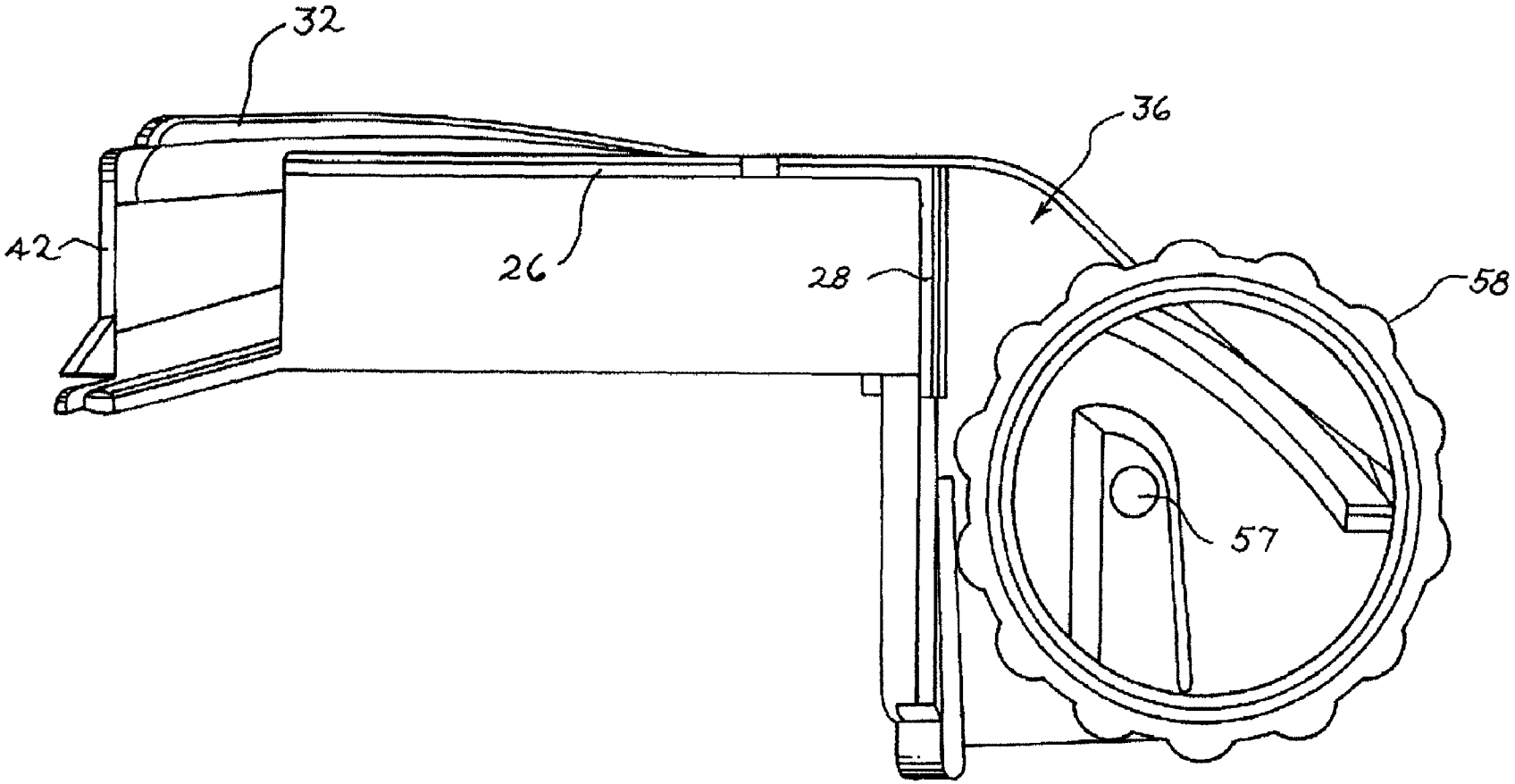
FIG. 8 is a side view of the hood assembly of FIG. 5.

When the hood door 24 is selectively rotated to the second operative position, as illustrated in FIGS. 4 and 8, the hood door 24 is located at a position immediately adjacent to the carriage assembly 16, thereby closing the outlet aperture 50 between the hood door 24 and the carriage assembly 16 to prevent loose chips from exiting the collection portion 36 into the surrounding working area. The carriage assembly 16 provides another limit to the rotation of the hood door 24 relative to the manifold 22, whereby the hood door 24 is in an abutting relationship with the carriage assembly 16 when the hood door 24 is located at the second operative position. The second operative position of the hood door 24 allows for the hood assembly 10 to be in a vacuum mode in which a vacuum hose 52 is attachable to the exhaust port 38 such that the loose chips can be removed from the collection portion 36 of the manifold 22 to a central storage location.

The manifold 22 and the hood door 24 are preferably made of a transparent material, thereby allowing the user to be able to view the collection portion 36 of the manifold 22 in case the chips accumulate and clog either the outlet aperture 50 or the exhaust port 38. It should be understood that the manifold 22 and hood door 24 can also be formed of a material that is not transparent. The hood assembly 20 can be made of plastic, metal, thermoplastic, or any other material sufficient to withstand the contact between the loose chips expelled from the carriage assembly 16 and the bottom surface 46 of the contoured member 32. In one embodiment, the manifold 22 and the hood door 24 are formed of the same material. In an alternative embodiment, the manifold 22 and the hood door 24 are formed of different materials.

Actuation of the hood door 24 relative to the manifold 22 allows the user to selectively determine the manner in which the loose chips are disposed by utilizing a single hood assembly 20. Prior art planers utilized a shield or cover that is specifically designed for either an exhausting mode in which the loose chips removed from the workpiece were expelled into the surrounding work area or a vacuum mode in which the loose chips were removed to a central storage location. When a user desired to switch between the exhausting the loose chips into the surrounding work area and attaching a vacuum to collect the chips using prior art shields or covers required the user to physically remove and replace the shield or cover to allow for the alternate operating mode. The hood assembly 20 eliminates the need for multiple shields or covers by providing a mechanism that allows the user to selectively choose the manner of exhausting the loose chips without the removal and replacement of the hood assembly 20. Eliminating the need for additional shields or covers for the different exhausting modes also reduces the overhead costs for the planer 10. The convertibility between the exhausting mode and vacuum mode also eliminates the need to store an additional shield or cover as well as eliminates the potential problems with the replacement of the shield or cover each time the user wishes to switch between operative modes.

Figure 10:
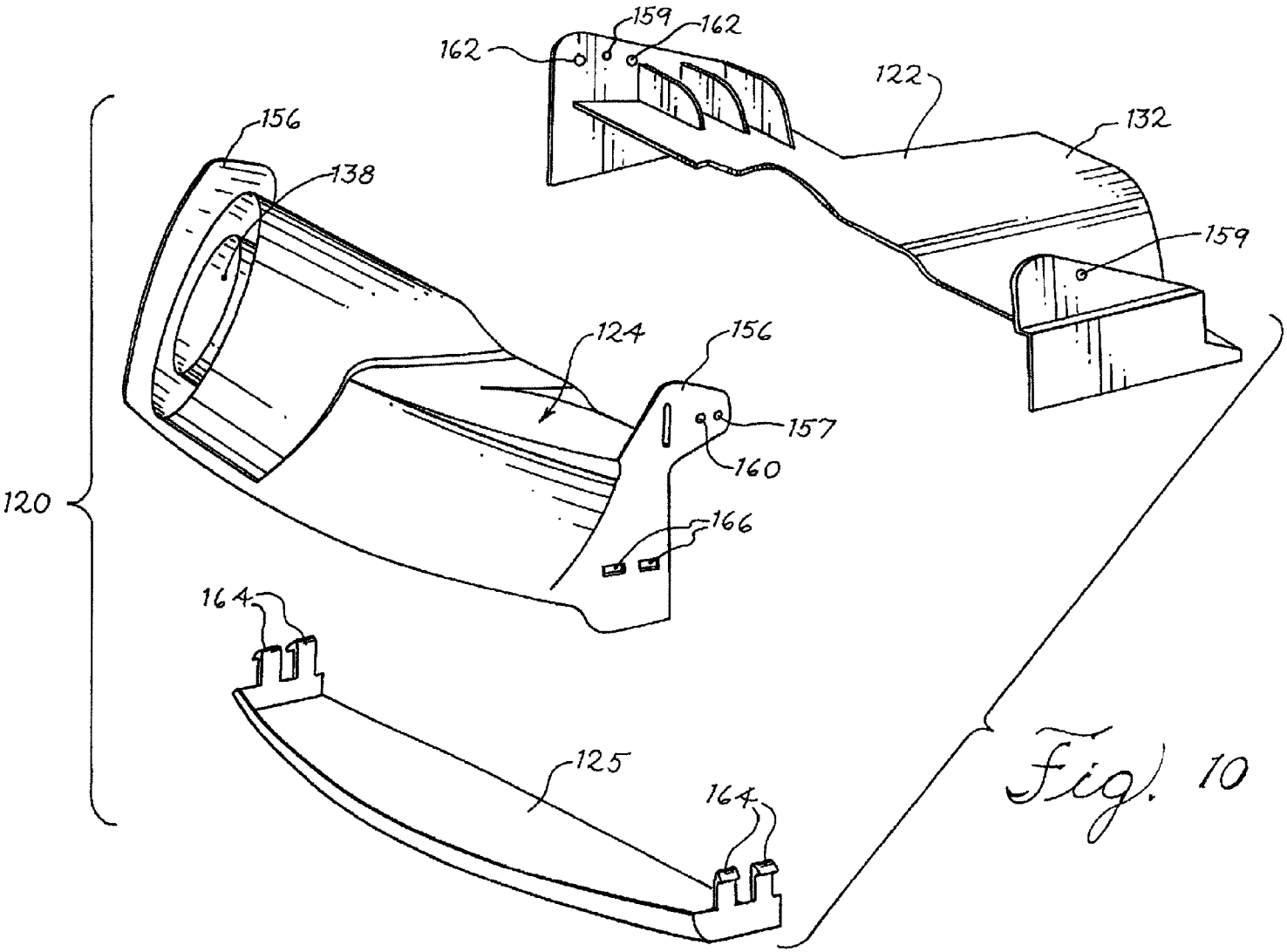
FIG. 10 is an exploded view of a second embodiment of a hood assembly.

FIG. 10 illustrates an alternative embodiment of a hood assembly 120. The hood assembly 120 includes a manifold 122, a hood door 124, and an extension member 125. The manifold 122 is releasably attachable to the carriage assembly 16 of the planer 10. The manifold 122 includes a contoured member 132 that is disposed adjacent to the exhaust port of the carriage assembly 16 when the hood assembly 120 is located in the operative position. The hood door 124 includes an exhaust port 138 integrally formed therewith. The exhaust port 138 is adapted to receive a vacuum hose (not shown) that is, in turn, attached to a vacuum. The hood door 124 includes a hinge member 156 disposed at each end, and the hinge member 156 is configured to provide a rotatable or pivotable attachment between the hood door 124 and the manifold 122. Each hinge member 156 of the hood door 124 includes a pin 157 that is received in an aperture 159 formed in the manifold 122. The pins 157 on the opposing hinge members 156 provide for an axis of rotation, thereby allowing the hood door 124 to rotate or pivot relative to the manifold 122.

Each hinge member 156 of the hood door 124 further includes a protrusion 160 extending outwardly from the hinge member 156. The manifold 122 includes a pair of detents 162 located adjacent to each aperture 159. The detents 162 in the manifold 122 are adapted to receive the protrusion 160 of the hood door 124, thereby providing the hood door 124 with at least two operative positions. The first operative position of the hood door 124 provides an exhausting mode in which the loose chips expelled from the carriage assembly 16 are directed downwardly toward the workpiece or into the surrounding working area. The second operative position of the hood door 124 provides a vacuum mode in which the loose chips expelled from the carriage assembly 16 are transferred through the exhaust port 138 into a vacuum hose that extends to a central storage location for the chips. The hood door 124 is selectively actuatable relative to the manifold 122 between at least the first operative position and the second operative position.

When the hood door 124 is located in the second operative position, an extension member 125 can be attached to the hood door 124 to prevent the loose chips from being expelled from between the hood door 124 and the carriage assembly 16. The extension member 125 is located immediately adjacent to the carriage assembly 16 when the hood door 124 is located in the second operative position. The extension member 125 is releasably attachable to the hood door 124. The extension member 125 is an elongated member having a pair of tabs 164 extending upwardly at each opposing end thereof. Each tabs 164 is received in a corresponding receiving aperture 166 formed in the hood door 124, but it should be understood by one skilled in the art that any other attachment mechanism sufficient to allow the extension member 125 to be releasably attached to the hood door 124 can be used. The extension member 125 can remain attached to the hood door 124 when the hood door is located in the first operative position, or the extension member 125 can be removed from the hood door 124 when the hood door 124 is in the first operative position.

Figure 11A:
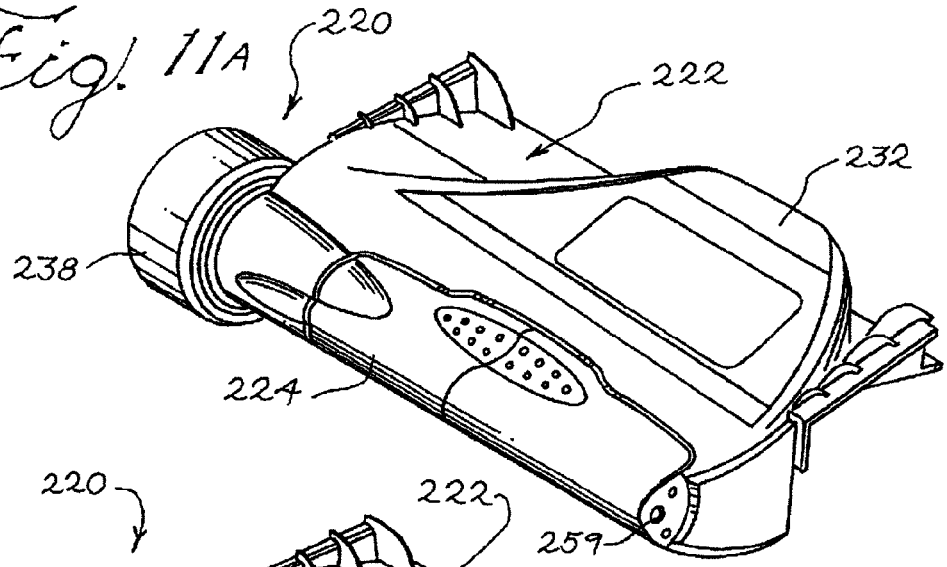
FIG. 11A is a third embodiment of a hood assembly.
Figure 11B:
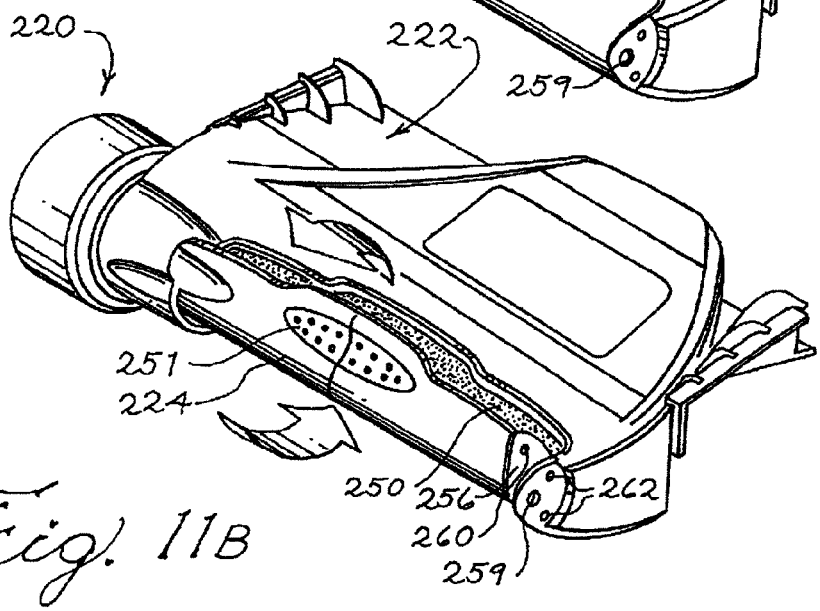
FIG. 11B is a top perspective view of the hood assembly of FIG. 11A shown in an exhausting mode.
Figure 11C:
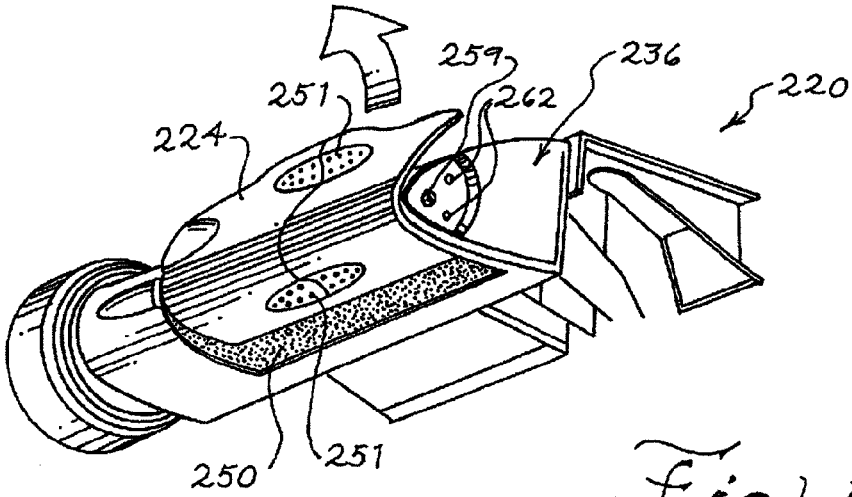
FIG. 11C is a bottom perspective view of the hood assembly of FIG. 11A shown in an exhausting mode.

Another alternative embodiment of a hood assembly 220 is shown in FIGS. 11A-11C. The hood assembly 220 includes a manifold 222 and a hood door 224 rotatably attached to the manifold 222. The manifold 222 includes a contoured member 232, an exhaust port 238, and an outlet aperture 250. The exhaust port 238 is integrally formed with the manifold 222, and the exhaust port 238 is adapted to receive a vacuum hose attached to a vacuum for transferring loose chips from the collection portion 236 of the manifold 222. The exhaust port 238 extends laterally from the collection portion 236 and is oriented in a direction aligned with the length of the collection portion 236 of the manifold 222.

The hood door 224 is rotatably or pivotably attached to the manifold 222, as illustrated in FIGS. 11B-11C. The hood door 224 is an elongated U-shaped member that is formed in substantially the same shape as the outlet aperture 250. The hood door 224 is rotatable or pivotable between at least a first operative position and a second operative position relative to the manifold 222. When the hood door 224 is located in the first operative position (FIGS. 11B-11C), the outlet aperture 250 of the manifold 222 is open in an unsealed manner and the loose chips are expelled through the outlet aperture 250. When the hood door 224 is located in the second operative position (FIG. 11A), the hood door 224 forms a seal with the outlet aperture 250 such that the outer edges of the hood door 224 are in an abutting relationship with the edges of the outlet aperture 250. The vacuum hose 52 can be operatively attached to the exhaust port 238 to remove the chips that are directed to the collection portion 236 of the manifold 222 when the hood door 224 is in the second operative position.

The hood door 224 includes a pair of grips 251 located on the opposing outer surfaces, as shown in FIG. 11C. The user pushes a grip 251 in order to rotate or pivot the hood door 224 relative to the manifold 222, thereby switching the hood assembly 220 between a first operative, exhausting mode and a second operative, vacuum mode. The hood door 224 includes a hinge member 256 located at each distal end thereof. The hinge member 256 of the hood door 224 includes a pin (not shown) that is received in an aperture 259 formed in the manifold 222. The hinge member 256 further includes a pair of protrusions 260 extending outwardly from the hinge member 256. Each protrusion 260 of the hinge member 256 is receivable within a detent 262 formed in the manifold 222. The detents 262 define a first operative position and a second operative position of the hood door 224 relative to the manifold 222.

Figure 12:
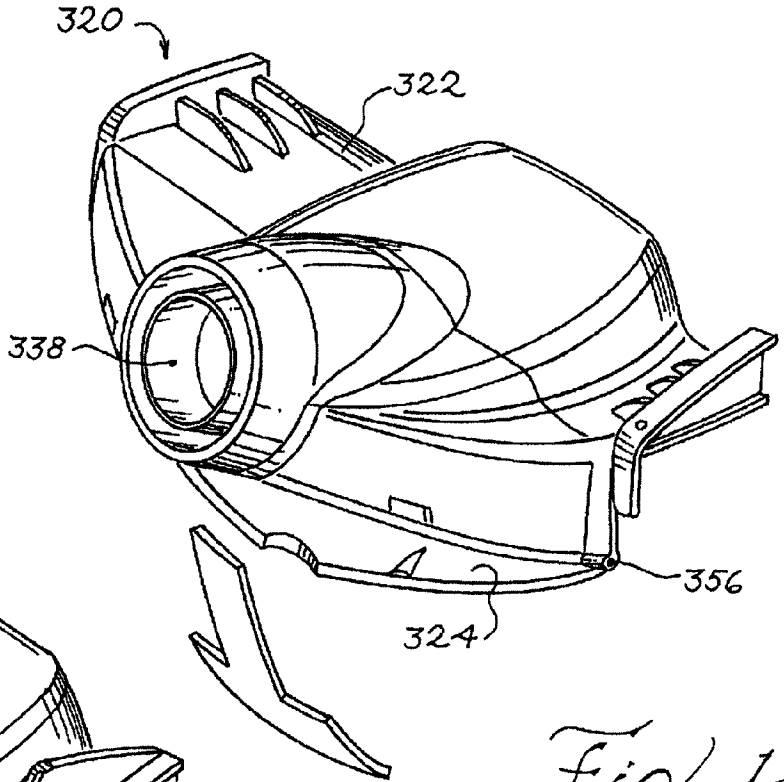
FIG. 12 is a fourth embodiment of a hood assembly.

A further alternative embodiment of a hood assembly 320 is illustrated in FIG. 12. The hood assembly 320 includes a manifold 322 that is releasably attachable to the carriage assembly 16 of a planer 10. The manifold 322 includes an exhaust port 338 integrally formed therewith. The exhaust port 338 is adapted to receive a vacuum hose (not shown) to transfer the chips removed from a workpiece being planed to a central storage location. The hood assembly 320 further includes a hood door 324 that is rotatably or pivotably attached to the manifold 322. The hood door 324 includes a hinge member 356 at each end thereof, and the hinge members 356 provide an axis of rotation such that the hood door 324 is rotatable relative to the manifold 322 to provide at least two operative modes.

When a vacuum hose 52 is disconnected from the exhaust port 338, the hood door 324 is rotated or pivoted about the opposing hinge members 356 in a downward manner relative to the manifold 322 to a first operative position in which the hood door 324 is spaced-apart from the manifold 322. The first operative position of the hood door 324 provides a first operative, exhausting mode in which the chips removed from a workpiece are expelled through the opening defined between the hood door 324 and the manifold 322. When a vacuum hose 52 is operatively attached to the exhaust port 338 of the manifold 322, the hood door 324 is actuated to a second operative position in which the hood door 324 is in an abutting relationship with the manifold 322 such that the opening between the hood door 324 and the manifold 322 when the hood door is in the first operative position is closed. The second operative position of the hood door 324 provides a second operative, vacuum mode in which chips removed from a workpiece are transferred from the hood assembly 320 by way of the exhaust port 328 through a vacuum hose to a central storage location. The hood door 324 is selectively actuatable between at least the first operative position and the second operative position relative to the manifold 322.

Figure 13:
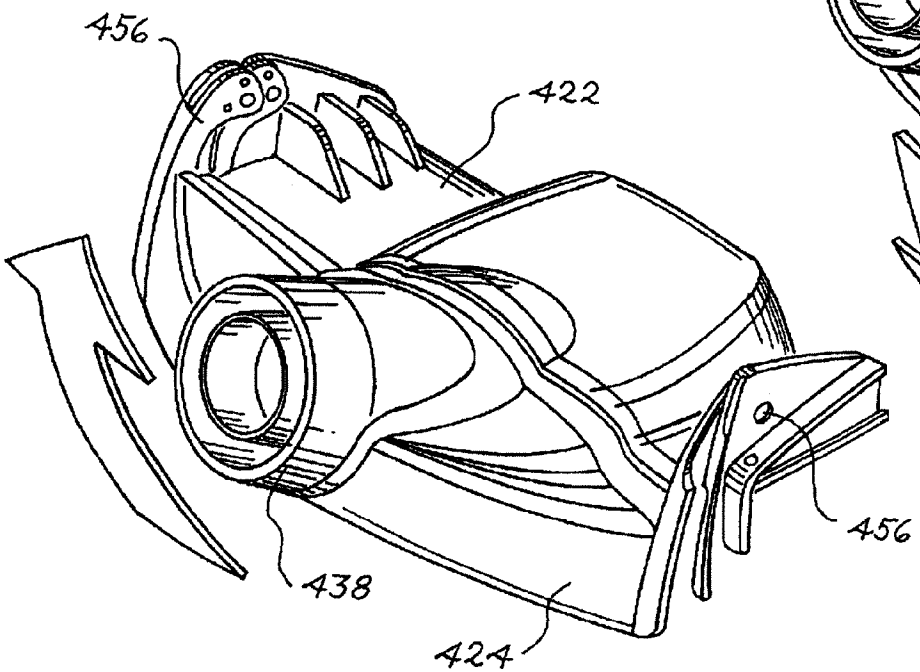
FIG. 13 is a fifth embodiment of a hood assembly.

A further alternative embodiment of a hood assembly 420 is shown in FIG. 13. The hood assembly 420 includes a manifold 422 and a hood door 424 rotatably connected to the manifold 422. The manifold 422 is attachable to the carriage assembly 16 of a planer 10 at an operative position. The hood door 424 includes an exhaust port 438 integrally formed therewith. The hood door 424 includes a hinge member 456 at each end, and the hinge members 456 are rotatably or pivotably connected to the manifold 422 to allow the hood door 424 to be selectively actuatable between at least a first operative position and a second operative position relative to the manifold 422.

When a vacuum hose (not shown) is disconnected from the exhaust port 438, the hood door 424 is rotated or pivoted about the opposing hinge members 456 in an upward manner relative to the manifold 422 to a first operative position in which the hood door 424 is spaced-apart from the manifold 422. The first operative position of the hood door 424 provides a first, exhausting mode in which the chips removed from a workpiece are expelled through the opening defined between the hood door 424 and the manifold 422. When a vacuum hose 52 is operatively attached to the exhaust port 438 of the manifold 422, the hood door 424 is actuated to a second operative position in which the hood door 424 is in an abutting relationship with the manifold 422 such that the opening between the hood door 424 and the manifold 422 when the hood door 424 is in the first operative position is closed. The second operative position of the hood door 424 provides a second, vacuum mode in which chips removed from a workpiece are transferred from the hood assembly by way of the exhaust port 438 through the vacuum hose to a central storage location. The hood door 424 is selectively actuatable between the first operative position and the second operative position relative to the manifold 422.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. A convertible hood assembly for a surface planer where the planer comprises: a base having a first surface configured to support a workpiece and a carriage assembly vertically translatable relative to the base from a first position spaced a first distance from the first surface of the base to another position spaced another distance from the first surface of the base different from the first distance where the carriage assembly includes a blade assembly for planing a side of the workpiece opposite the side supported by the first surface of the base and that is disposed between said carriage assembly and said base while the workpiece is moved relative to the carriage assembly and base, wherein the hood assembly includes a manifold that is releasably attachable to the carriage assembly of said surface planer, said manifold having an outlet aperture through which chips from a workpiece can be expelled; and a hood door rotatably attached to said manifold, wherein said hood door is actuatable between at least a first operative position where chips are expelled from a first location and a second operative position where chips are expelled from a second location.

2. The convertible hood assembly of claim 1, wherein when said hood door is located in said first operative position an exhausting mode in which said chips are expelled from a collection portion of said manifold is provided.

3. The convertible hood assembly of claim 2, wherein when said hood door is located in said second operative position provides a vacuum mode in which said chips are removed from said collection portion of said manifold by way of a vacuum hose operatively attached to an exhaust port integrally formed with said manifold or said hood door is provided.

4. The convertible hood assembly of claim 3, wherein said exhaust port is integrally formed with said manifold.

5. The convertible hood assembly of claim 3, wherein said exhaust port is integrally formed with said hood door.

6. The convertible hood assembly of claim 1, wherein said hood door includes a hinge member located at one end of said hood door, and said hinge member is rotatably attachable to said manifold.

7. The convertible hood assembly of claim 6, further including an exhaust port and wherein said hood door includes a dial located at an end of said hood door opposite said hinge member, said dial is adjacent to, and rotatable with respect to said exhaust port.

8. The convertible hood assembly of claim 7, wherein rotation of said dial actuates said hood door between said first operative position and said second operative position.

9. The convertible hood assembly of claim 1, wherein said hood door includes a dial for rotatably actuating said hood door between said first operative position and said second operative position.

10. The convertible hood assembly of claim 1, wherein said hood door is rotatable relative to said manifold.

11. The convertible hood assembly of claim 1, wherein said manifold and said hood door are formed of a transparent material.

12. The convertible hood assembly of claim 1, wherein said manifold includes at least one protrusion extending therefrom.

13. The convertible hood assembly of claim 12, wherein said hood door includes at least one detent adapted to receive said at least one protrusion extending from said manifold.

14. The convertible hood assembly of claim 13, wherein said first operative position of said hood door is defined by the location at which said protrusion of said manifold is received in said detent of said hood door.

15. The convertible hood assembly of claim 14, wherein said hood door is disposed at a position immediately adjacent to said carriage assembly when said hood door is located in said second operative position.

16. A method for converting a surface planer between a first operative mode and a second operative mode comprising: attaching a hood assembly to said surface planer, said hood assembly includes a manifold and a hood door, wherein said hood door is actuatable between at least a first operative position and a second operative position relative to said manifold; actuating said hood door between said first operative position which provides said first operative mode where chips are expelled from a first location and said second operative position which provides said second operative mode where chips are expelled from a second location.

17. The method of claim 16, wherein said hood door is rotatable relative to said manifold.

18. The method of claim 17, wherein said hood door includes a dial integrally formed therewith.

19. The method of claim 18, wherein said dial is rotatable about an exhaust port that is integrally formed with said manifold, and said exhaust port can receive a vacuum tube when said hood door is in said second operative position.

20. The method of claim 16, wherein said first operative mode is an exhausting mode in which said chips are expelled through an outlet aperture.

21. The method of claim 20, wherein said second operative mode is a vacuum mode in which a vacuum hose is attached to an exhaust port integrally formed with said manifold or said hood door for removing said chips from said surface planer.

22. A planer comprising: a base; a plurality of columns extending from said base; a carriage assembly operatively connected to said columns, said carriage assembly being translatable relative to said base, and said carriage assembly including a blade assembly for planing a workpiece disposed between said carriage assembly and said base; a hood assembly attached to said carriage assembly, said hood assembly includes a manifold releasably secured to said carriage assembly and a hood door actuatably connected to said manifold, wherein said hood door includes a dial for selectively rotating said hood door between at least a first operative position and a second operative position relative to said manifold for converting said hood assembly between a first operative mode where chips are expelled from a first location and a second operative mode where chips are expelled from a second location.

* * * * *